US008870445B2

(12) United States Patent
Burns, II

(10) Patent No.: US 8,870,445 B2
(45) Date of Patent: Oct. 28, 2014

(54) LIQUID ACCELERATOR AND CHEMICAL MIXING APPARATUS AND METHOD

(76) Inventor: Gordon C. Burns, II, Missoula, MT (US)

( * ) Notice: Subject to any disclaimer, the term of this patent is extended or adjusted under 35 U.S.C. 154(b) by 906 days.

(21) Appl. No.: 12/627,880

(22) Filed: Nov. 30, 2009

(65) Prior Publication Data

US 2010/0149906 A1 Jun. 17, 2010

Related U.S. Application Data

(60) Provisional application No. 61/193,651, filed on Dec. 12, 2008.

(51) Int. Cl.
*B01F 5/02* (2006.01)

(52) U.S. Cl.
CPC ..... *B01F 5/0212* (2013.01)
USPC ..... 366/163.2; 366/173.2; 417/179

(58) Field of Classification Search
CPC ..... B01F 5/0212; B01F 5/0426
USPC ..... 366/136, 137, 163.2, 173.2; 417/179, 417/180
See application file for complete search history.

(56) References Cited

U.S. PATENT DOCUMENTS 282,074 A * 7/1883 Grimm ..... 417/180
2,100,185 A * 11/1937 Engstrand ..... 417/170
2,786,651 A * 3/1957 Mickle ..... 175/206
3,457,863 A * 7/1969 Carter ..... 417/89
3,957,209 A * 5/1976 Thomson ..... 239/429
4,400,138 A * 8/1983 Baer ..... 417/179
4,487,553 A * 12/1984 Nagata ..... 417/171
6,171,508 B1 1/2001 Browning, Jr.
6,729,800 B2 5/2004 Burns, II
8,192,070 B2 * 6/2012 Allen ..... 366/136

OTHER PUBLICATIONS

Severn Trent De Nora, "Ballast Water Treatment System", Balpure®, Apr. 2009, 8 pages, 750.0005.2APR09, www.severntrentdenora.com, Sugar Land, TX, USA.
Gold Divers, "Couple-Jet® Specifications", Couple-Jet® Brochure, c. 1977, 4 pages, Gold Divers, Torrance, CA, USA.

* cited by examiner

*Primary Examiner* — David Sorkin
(74) *Attorney, Agent, or Firm* — William L. MacBride, Jr.

(57) ABSTRACT

The liquid accelerator and chemical mixing system apparatus is a means for generating a velocity head differential to a current of liquid in a liquid environment or liquid containment means or a natural water body. The generating means includes a venturi eductor, having a motive liquid distribution housing and at least one venturi nozzle. The venturi eductor functions by motive liquid introduced from a remote motive liquid source, received via the motive liquid attachment means passing through a motive liquid main pipe or cylinder, through the liquid distribution housing, which is circumferentially attached to the eductor tube. The generated velocity head differential induces and accelerates the current of liquid, enabling the venturi eductor to discharge a current of liquid to move objects within the liquid environment by directing the current of liquid and to induce and mix chemicals in a liquid containment means.

6 Claims, 5 Drawing Sheets

LIQUID ACCELERATOR AND CHEMICAL MIXING APPARATUS AND METHOD

This application claims priority from the provisional patent application filed Dec. 12, 2008, Application No. 61/193,651 and Confirmation Number 4790.

BACKGROUND

This invention relates to a liquid accelerator and chemical mixing apparatus and method, for inducing a liquid current, propelling and accelerating the current to move and direct objects and including a means and method for introducing gaseous or liquid chemical substances (chemicals) into the apparatus for mixing of any of such chemicals with pre-existing water and/or other liquids within a liquid containment means, for example, a ship ballast tank or other liquid container, vessel or receptacle, or other liquid containment means or environment. Specifically, the present invention relates to an apparatus and method for inducing, propelling, and delivering a current in ambient liquids in a natural or manmade environment, such as a container or tank, to direct and move natural objects (living or inanimate), and for mixing chemicals with the water or other liquid in a containment means by generating a water and/or other chemical, liquid flow current by the apparatus (and method) which creates a velocity head differential in the liquid environment or containment means.

The main disadvantages to any related art eductor devices currently known are their restricted abilities to provide a limited suction capacity, developing only a lower level current useful for limited purposes, such as moving rock particles in placer mining. As well, with regard to the chemical delivery and mixing related art, the cost to construct and maintain alternative mixing apparatuses in the related art for large scale mixing in tanks is a major disadvantage in such art. The apparatus and method of the present invention provides the means to induce a significant current in liquids to move substantial amounts of materials in a liquid environment in a propelling rather than suction mode and guide or direct them within the liquid current in any desired direction or location. The present invention can also provide the capacity to mix chemicals in any size container safely and efficiently, with easy access for maintenance, in a cost effective manner.

DESCRIPTION OF THE RELATED ART

While venturi eductors include, but are not limited to, suction power jets that are commercially available for use on gold, placer mining, and/or reclamation, such as suction dredges, none of the venturi eductors found on the market today are available with the functions of or for the use provided for by the present invention, liquid propulsion (inducing and accelerating a liquid) and mixing chemicals, and none contain the elements of the present invention, the one or more venturi nozzles included with a liquid distribution housing and a chemical induction port.

There is limited related art concerning an apparatus or method for inducing liquid currents by an eductor in a liquid environment, or the introduction of chemicals and the mixing of any of such chemicals with pre-existing water and/or other liquids within a liquid containment means, for example, a ship ballast tank or other liquid container. Related arts use suction dredging apparatuses, such as the mining equipment noted above, to move rock material from a suction inlet to an outlet for displacing that material and, as such, provide no suggestion, motivation or teaching for inducing a current and accelerating it through an eductor. The devices and methods that have been developed for inducing liquid currents by an eductor are of very limited capacity, not utilizing all of the elements of the present invention, as noted above. The only art known related to the present invention pertains to the use of an eductor for mechanical generation of water current for guiding or directing fish in a waterway, U.S. Pat. No. 6,729,800 B2 to Burns, II. The fish guiding claim limitations of the '800 patent would not be present in a ship's ballast tank or similar container use. As disclosed hereby, the present invention shows a device, while similar to the patented apparatus, also includes multiple venturi nozzles to produce a powerful suction capacity and strong current, and an unsuggested second induction port for introducing chemicals (such as biocides, detergents, cleansers, disinfectants, caustics, poisons, toxins, or other chemicals), into a liquid container, such as a ship's ballast tank. There is no suggestion, motivation or teaching in the '800 patent to modify the patented device to add multiple venturi nozzles, or the second induction port, nor to teach the uses being made of the present invention, to direct objects and to mix chemicals rather than guide fish, necessarily requiring inducing lower levels of stream currents to attract fish. No other patents have been found to teach the improvements of the present invention.

The devices and methods for chemical mixing in a tank or other container that have been developed are either of a common manual broadcast or dispersal method, or an equally well known mechanical agitator or propellor type mechanism to mix amounts of liquid, for example, U.S. Pat. No. 6,171,508 B1 to Browning, Jr. The '508 patent teaches a water treatment system utilizing a series of pumps, mixing tanks and filter located outside the ballast tank, aerating water by means of an agitator. This is a complicated, expensive and space-consuming system relative to the present invention. While all of these known mixing mechanisms present potential chemical exposure or other safety concerns, particularly for handling large amounts of chemicals, none function in a manner remotely similar to the present invention. In these respects, it can be considered that there is no prior art whatsoever relating to the present invention.

As well, there is no suggestion, motivation or teaching in the '800 patent to modify the patented device to add the flared intake end to the venturi eductor and additional venturi nozzles in a liquid distribution housing of the present invention to create the degree of suction obtained in the present invention to induce and accelerate a current in liquid, to direct and move objects in the liquid, nor to teach the use being made of the present invention to mix chemicals rather than guide fish.

Venturi eductors known in the related art use a single port or dual port motive water entry. One manufacturer, apparently closed and no longer in production (Gold Divers), used a 360° principle, having an intake slot, a machined collar and sleeve. The single port and dual port used with the Gold Divers equipment are inefficient in the larger size (12 inch-16 inch and larger) units and require more motive water or other liquid and higher pressures to achieve its maximum potential. The Gold Divers units have a small aperture slot that provides motive water all the way around the eductor tube. This is a wear area and also an area that plugs easily even when screened. This creates a maintenance problem. The present invention achieves a 360° motive liquid entry without machined parts to wear out or cause an area of "plugging". The present invention consists of the following:

i. A motive liquid distribution ring around the eductor tube. The distribution ring has an inlet or multiple inlets (depending on the size) for motive liquid;

ii. A deflection device (splitter) beneath the inlet to evenly disperse the motive liquid around the distribution ring;

iii. Multiple nozzles, evenly distributed around the circumference of the eductor. The size and number of nozzles is determined by the size of the eductor and the motive liquid required by that size.

Advantages over related art:

1. Achieves the maximum potential of the liquid accelerator with less liquid and a reduced liquid pressure;
2. A reduced unit cost due to #1 above;
3. No wear parts to replace; (as opposed to Gold Divers)
4. No plugging due to minimal clearances; and
5. Reduced cost over Gold Divers 360° venturi and related art (no machine parts).

Venturi eductors known in the related art are used for their suction capabilities as noted above, such as gold dredging. Therefore, a flare or bell at the intake end is not desirable as it lessens that suction, and has never been suggested. Also, a flare or bell would make it difficult to attach a hose to the eductor. The present invention incorporates a flare or bell to reduce the amount of vacuum at intake by increasing the square area of the venturi eductor at the suction end. It consists of a band affixed to the suction end that flares from the venturi eductor diameter (i.e. 8 inch) to a larger diameter (i.e. 16 inch). The length of this band is determined by the increase in diameter so as to achieve a smooth transition from one diameter to another.

Advantages over related art:

1. Reduces the effort of the venturi eductor to draw liquid, and provides a smoother hydraulic flow into the eductor tube. This reduces the horse power requirements of the motive liquid pumps to draw water or other liquid and makes it available for pushing water or other liquid. This provides a more efficient use of horse power.
2. Reduced unit cost, because pumps can be smaller and still achieve maximum performance.

Venturi eductors known in the related art are not used for their ability to move large quantities of water or other liquid efficiently. Therefore, there has never been a need, suggestion, or motivation to add additional nozzles or a chemical induction port. The present invention incorporates multiple venturi nozzles fastened to the suction end at an angle. An induction port allows the venturi effect, created in the eductor to draw other liquids, such as chemicals or biocides into the eductor without the use of pumps. This allows the unit to disinfect, clean, or "biocide" a large contained body of water or other liquid without adding said chemicals by hand or through additional equipment.

Advantages over related art:

1. Allows for efficient treatment of contained bodies of water or other liquid;
2. No moving parts to wear out;
3. No additional equipment needed for chemical introduction; and
4. Premixing of chemicals in the venturi eductor.

No other patents have been found to teach the improvements of the present invention. All of the foregoing related art invention devices and methods to induce, accelerate and direct liquid currents or mix chemicals suffer from one or more of the disadvantages set forth here, including: lack of efficiency in operation, safety weaknesses, and/or cost of installment and maintenance.

SUMMARY AND OBJECTIVES OF THE PRESENT INVENTION

The liquid accelerator and chemical mixing system apparatus is a means for generating a velocity head differential to a current of liquid in a liquid environment or liquid containment means or a natural water body. The current of liquid may be formed in any liquid including water in a natural liquid environment or a ship ballast tank; or industrial liquids processed in large vats or tanks, such as liquid food products or industrial chemicals. The generating means includes a venturi eductor, having a motive liquid distribution housing and at least one venturi nozzle. The venturi eductor functions by high pressure motive liquid introduced from a remote motive liquid source, received via the motive liquid attachment means passing through a motive liquid main pipe or cylinder, through the liquid distribution housing, which is circumferentially attached to the eductor tube.

The apparatus is installed in the liquid environment so that the generated velocity head differential will induce and accelerate the current of liquid, enabling the venturi eductor to discharge a current of liquid to move objects within the liquid environment, by a means for directing the current of liquid in the liquid environment, directing an object in any desired direction. The apparatus in a liquid containment means induces and mixes chemicals to a current of liquid, by a means for introducing chemicals into the eductor through a chemical induction port, for example, within ship ballast tanks, for purposes such as eliminating invasive exotic and non-indigenous organisms and preventing their introduction into a shipping waterway. Alternatively, this method could be used to introduce and circulate cleaning (detergent or disinfectant) agents into a liquid containment means.

The present invention has many objectives. Among them are the following:

To provide an apparatus and method as aforesaid in which the step of using the generated head differential to induce and accelerate a current of water or other liquid within a liquid containment means includes: providing a venturi eductor having an eductor tube including a sidewall defining a bore extending there through, said eductor tube having a liquid intake end and a liquid discharge end; and multiple venturi nozzles having liquid inlet and outlet ends, said venturi nozzles having the outlet ends connected in liquid conducting relationship to the eductor tube at an acute angle directed toward the discharge end of the eductor tube;

To provide an apparatus and method as aforesaid in which the step of generating a velocity head differential includes: providing a pressure motive water or other liquid source connected in water conducting relationship with the venturi nozzle thereby creating reduced pressure within said eductor tube so such that during operation of the pressure motive water or other liquid source is drawn into the eductor tube at the intake end at a first velocity and discharged at the discharge end at a velocity greater than the first velocity at the intake end;

To provide an apparatus and method to draw chemicals being introduced into an eductor and premix the chemicals with liquids, such as water, being discharged from an eductor, accelerating the mixing process, saving time and money;

To provide an apparatus and method to draw or introduce chemicals safely into an eductor;

To provide an apparatus and method to safely store and deliver chemicals, through pipes or other delivery or dispensing system, to an eductor, eliminating the need to deliver chemicals by hand, lessening the likelihood of spills, contamination or injury from dispensing the chemicals; and To provide a method for providing a liquid acceleration and chemical mixing system in a liquid tank comprising the steps of generating a plurality of velocity head differentials, using the plurality of generated velocity head differentials to create a plurality of currents of liquid within a liquid containment means.

The aforementioned features, aspects and advantages of the present invention, and further objectives and advantages of the invention will become apparent from a consideration of the drawings and ensuing description.

BRIEF DESCRIPTION OF THE DRAWINGS

The foregoing features and other aspects of the present invention are explained in the following description, taken in conjunction with the accompanying drawings. Other features and objects of the present invention will become apparent from the following detailed description taken in combination with the accompanying drawings. However, the drawings are provided for purposes of illustration only, and are not intended as a definition of the limits of the invention.

DETAILED DESCRIPTION

The present invention will now be described more fully hereinafter with references to the accompanying drawings, in which the preferred embodiment of the invention is shown. This invention may, however, be embodied in different forms, and should not be construed as limited to the embodiment set forth herein. Rather, the illustrative embodiments are provided so that this disclosure will be thorough and complete, and will fully convey the scope of the invention to those skilled in the art. It should be noted, and will be appreciated that numerous variations may be made within the scope of this invention without departing from the principle of this invention and without sacrificing its chief advantages. Like numbers refer to like elements throughout.

Figure 1:
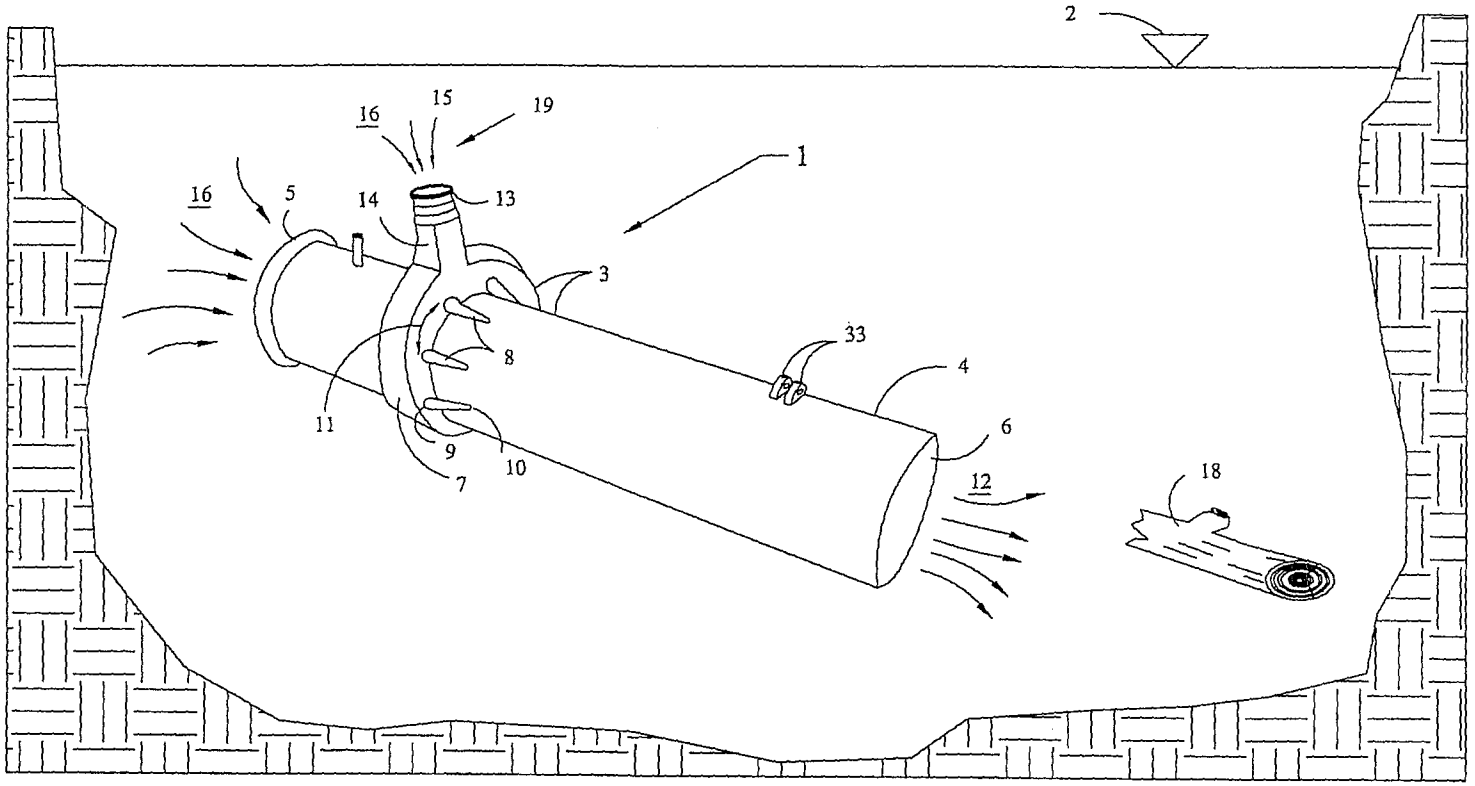
FIG. 1 illustrates a perspective view of the preferred embodiment of a liquid accelerator and chemical mixing system in a liquid environment directing an object, according to the present invention.

Turning now in detail to the drawings, in accordance with the present invention, one embodiment of the invention, the liquid accelerator and chemical mixing system, is shown in FIG. 1, a perspective view of the apparatus 1, or eductor assembly, a means for generating a velocity head differential to a current of liquid 12 in a liquid environment 2, such as a manmade tank, container, vat, ballast tank, or other liquid containment means 20 (shown in FIG. 5); or a natural water body, such as a lake, pond, river or other waterway. The current of liquid 12 may be formed in any liquid including water in a natural liquid environment or a ship ballast tank; or industrial liquids processed in large vats or tanks, such as liquid food products or industrial chemicals. The generating means includes a venturi eductor 3 which has an eductor tube 4 including a sidewall 4*a* defining a bore extending there through, and a liquid intake end 5 and a liquid discharge end 6. The liquid intake end 5 further comprises a flared collar 30.

Figure 2:
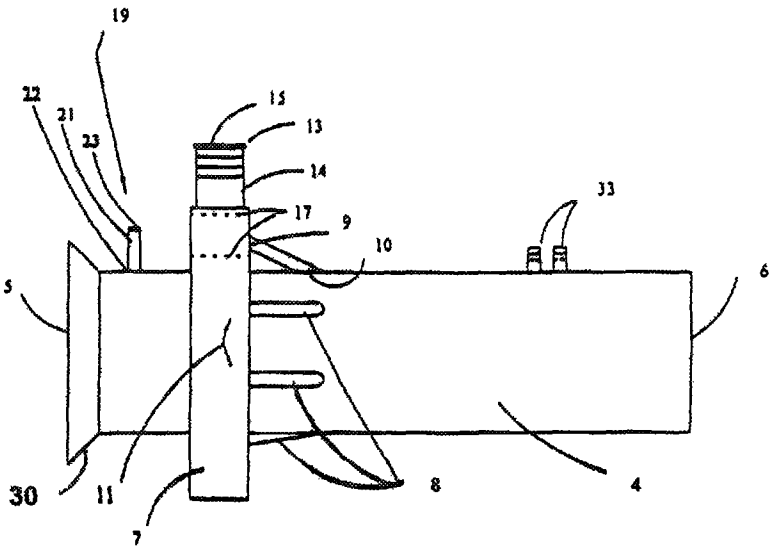
FIG. 2 illustrates an elevated side view of the preferred embodiment of a liquid accelerator and chemical mixing system according to the present invention, having a venturi eductor, at least one venturi nozzle, a motive liquid distribution housing, a chemical induction port, and a flared collar at an intake end of an eductor tube.

As further depicted in FIGS. 1 and 2, an elevated side view of the preferred embodiment, the apparatus generating means 1 includes a motive liquid distribution housing 7 located toward the liquid intake end 5 of the eductor tube 4, along a circumference of the eductor tube 4. The motive liquid distribution housing 7 has at least one venturi nozzle 8. Each venturi nozzle 8 has a liquid inlet end 9, connected in liquid conducting relationship to said housing 7, and a liquid outlet end 10, connected in liquid conducting relationship to the eductor tube 4. The one or more (multiple) venturi nozzles 8 are located at equally spaced intervals 11 along the circumference of the eductor tube 4. The venturi eductor 3, as well as the entire eductor apparatus 1 assembly is preferably made of metallic, rigid components.

Figure 3:
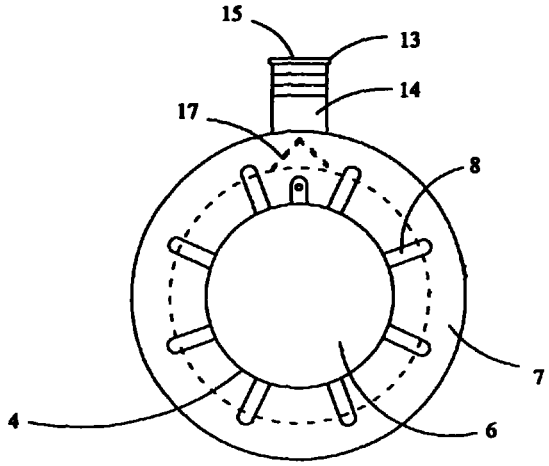
FIG. 3 illustrates an elevated front end view of FIG. 2, according to the present invention facing the discharge end of an eductor and having the liquid distribution housing with a liquid distribution splitter.
Figure 6:
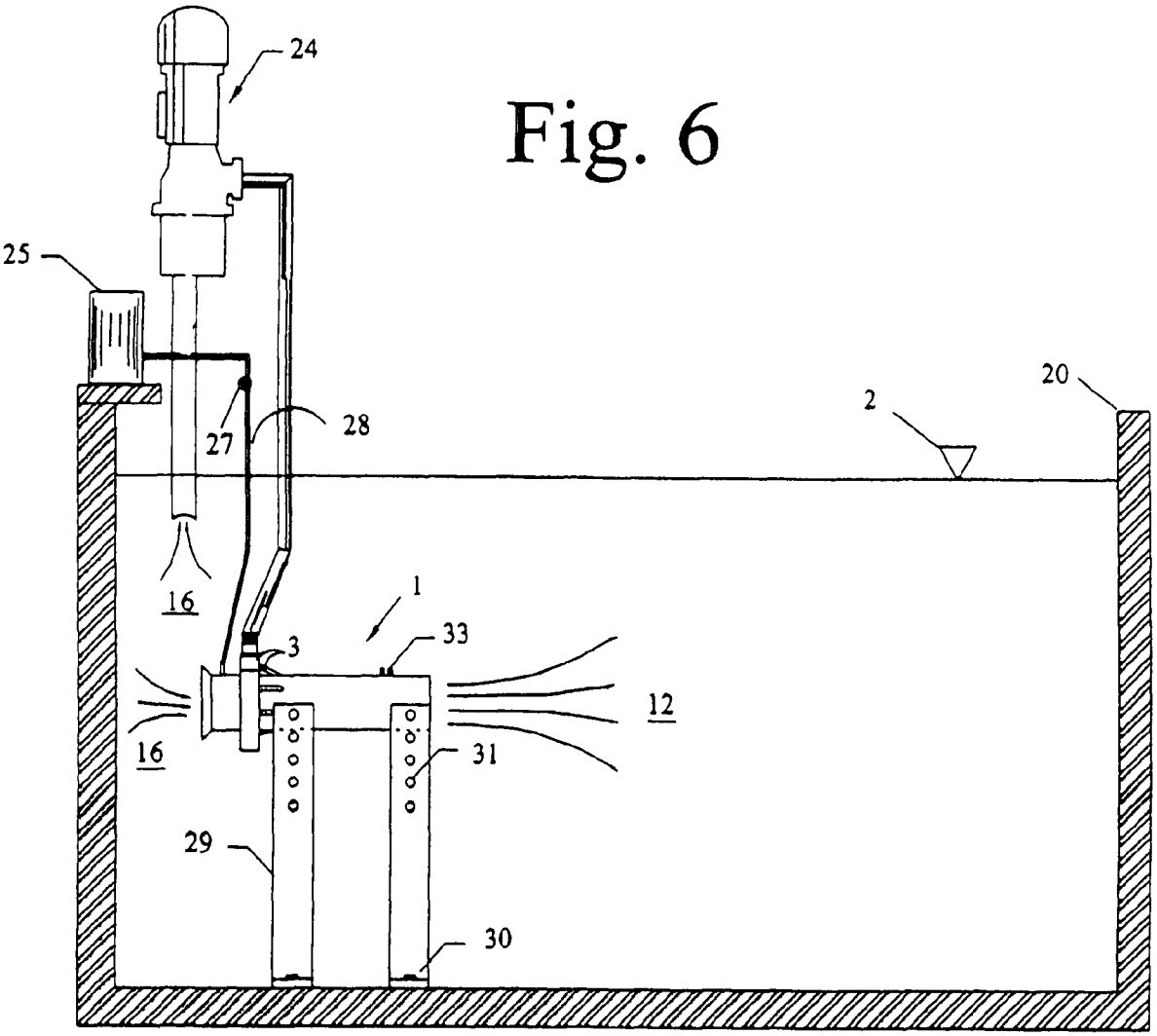
FIG. 6, an elevated side view, illustrates an alternative embodiment, with an alternative submersible pump as a motive water or other liquid source, having a pump feed tube, according to the present invention, when used for introducing and mixing chemicals, the apparatus being attached within a liquid containment means.

The apparatus 1 of the present invention; as shown in FIGS. 1, 2, and 3, an elevated front end view, facing the liquid discharge end 6 of the eductor tube 4, depict a means for delivering motive liquid 16 to the liquid distribution housing 7, including a motive liquid main pipe 14, which is in liquid conducting relationship to said housing 7, and a motive liquid attachment means 13 to cooperatively receive the motive liquid 16 into the motive liquid main pipe 14. The attachment means may be any form of leak-proof coupling means to secure said main pipe 14 to a delivery mechanism for the motive liquid 16, if required, such as threaded pipe, pressure fittings or other coupling or joining means. Said delivery means 15 may be a pump 24 (FIG. 6).

As shown in FIGS. 2 and 3, the liquid distribution housing 7 contains and utilizes a liquid distribution splitter means 17, such as an angle flange or other current altering mechanism to control the distribution of the motive liquid 16 delivered by this means. In doing so, the liquid distribution splitter means 17 prevents cavitation, eddying or other deleterious actions by the motive liquid 16 as it is distributed to the venturi nozzles 8.

Returning to FIG. 1, the preferred embodiment of the present invention, the apparatus 1 is installed in the liquid environment 2 so that the generated velocity head differential will induce and accelerate the current of liquid 12. The liquid intake end 5 of the venturi eductor 3 receives the current of liquid 12, and the liquid discharge end 6 of the venturi eductor 3 discharges the current of liquid to move objects 18, within the liquid environment 2, such as log debris, as depicted in FIG. 1, or other natural, living or inanimate objects, including manmade objects. The apparatus 1 of the present invention is a means for directing the current of liquid 12 in the liquid environment 2 and, thereby directing the object 18 in any desired direction; for example, directing and corralling floating debris, guiding flora or fauna, or propelling swimmers as a recreational apparatus.

Figure 5:
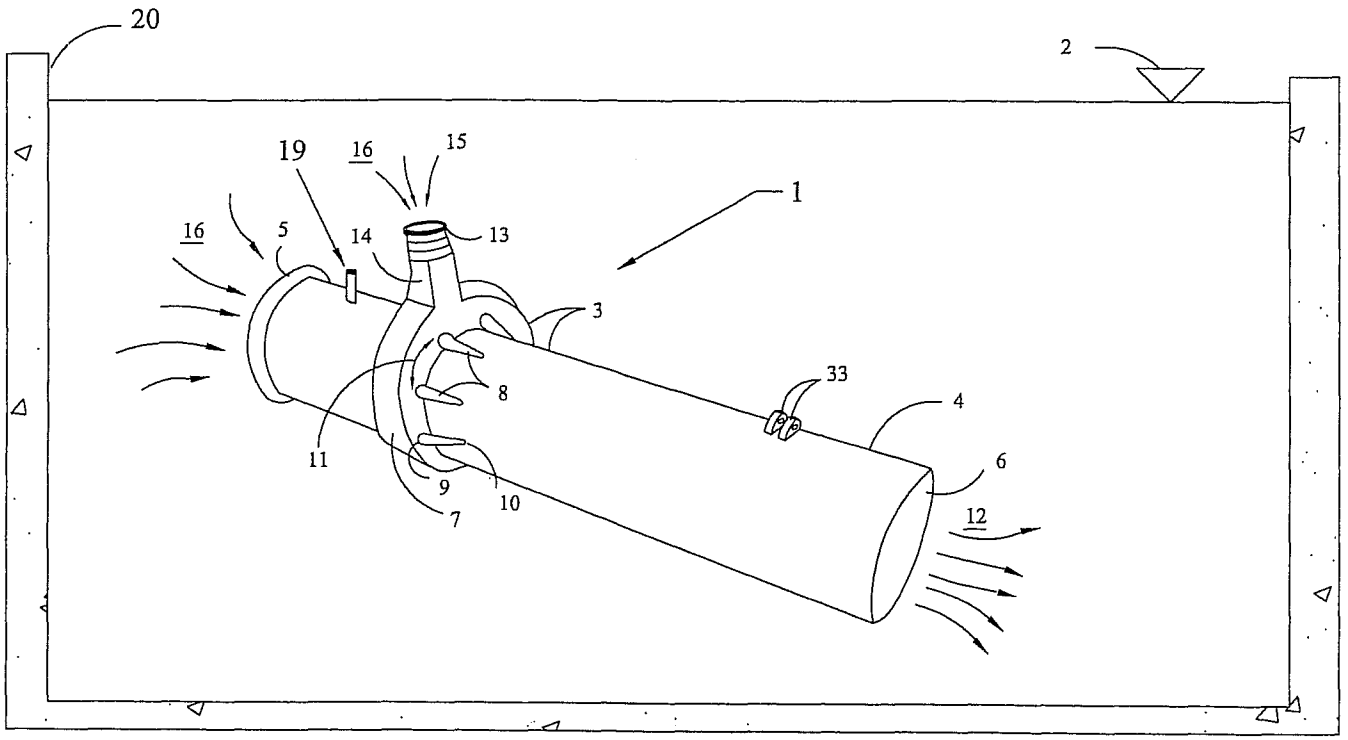
FIG. 5 illustrates a perspective view of FIG. 1, according to the present invention, in a liquid containment means.

The apparatus 1, as depicted in FIGS. 1 and 5, a perspective view according to the present invention in a liquid containment means 20, induces and mixes chemicals 19 to a current of liquid 12. The apparatus 1 functions as a means for using the generated velocity head differential, in the same manner as already described herein, when installed in the liquid containment means 20, to induce and accelerate the current of liquid 12 within the containment means 20.

Figure 4:
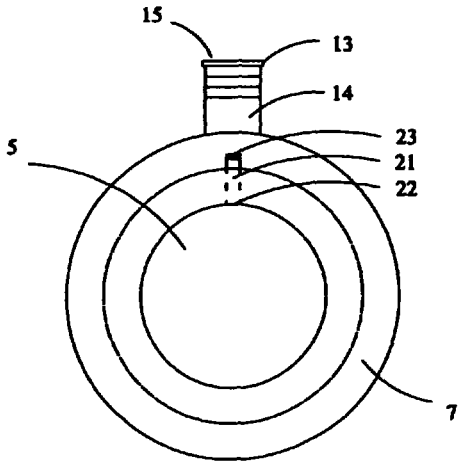
FIG. 4 illustrates an elevated back end view of FIG. 2 according to the present invention, having the chemical induction port.

As showing in FIGS. 3 and 4, elevated front and back end views, according to the present invention, at the liquid intake end 5 of the venturi eductor 3, and FIG. 5, perspective view, the apparatus 1 is a means for introducing chemicals 19 into the eductor tube 4, through a chemical induction port 21, which has a chemical inlet end 22 and an opposite chemical line end 23. The chemical line end 23 is connected in chemical conducting relationship to a chemical feed line 28, as depicted in FIG. 6, an elevated side view, illustrating the chemical feed line 28 utilized in alternative embodiments of the present invention. The chemical induction port 21 is in chemical supplying relationship to the eductor tube 4, and is located on the eductor tube 4 between the venturi nozzle 8 or multiple nozzles and the liquid intake end 5.

As shown in FIG. 6, the preferred embodiment of the present invention as an apparatus or method consists of using the venturi eductor 3 as a source for creating a water (or other chemical) velocity head differential, in conjunction with a motive liquid 16 delivery means 15, connected to the venturi eductor 3 to create high pressured motive liquid 16, for generating a current of liquid 12, a liquid flow current, to move and direct objects 18, such as debris or animals in a water impoundment or other liquid environment 2 or containment means 20 (FIG. 1), and to introduce chemicals 19 into the liquid environment 2 or containment means 20 areas, for example, as ship ballast tanks, for purposes, such as eliminating invasive exotic and non indigenous organisms and preventing their introduction into a shipping waterway. Alternatively, this method could be used to introduce and circulate cleaning (detergent or disinfectant) agents into a liquid containment means 20 area. The venturi eductor 3 functions by highly pressured motive liquid 16 introduced from the delivery means 15 being a remote motive liquid source, such as a pump 24, the motive liquid 16 is being received via the motive liquid attachment means 13 passing through a motive liquid main pipe 14 or cylinder, through the liquid distribution housing 7, which is circumferentially attached to the eductor tube 4, and dispersed into liquid inlet ends 9 of one or more venturi nozzles 8 set at acute angles, at the liquid outlet ends 10 directed toward the discharge end 6 of the eductor tube 4.

In one embodiment, depicted in FIGS. 5 and 6, highly pressured motive liquid 16 is provided by the delivery means 15, such as the pump 24, and delivered to the venturi eductor 3 by the venturi nozzle 8 through a suitable conduit 32 or hose to the motive liquid attachment means 13. The pump 24 that provides motive liquid 16 can be powered by many sources, such as an electric or hydraulic motor, or a gasoline or diesel engine. Alternatively, where suitable conditions exist, the motive liquid 16 can be supplied by other means, including but not limited to a siphon pipe, whereby high pressure motive liquid 16 is produced by natural head pressure in lieu of the pump 24. The pump 24 may be a submersible, shore-mounted or other type of commercially available pump, including but not limited to one-half (0.5) to five hundred (500) horsepower or greater depending on motive water needs.

Reviewing, again, FIGS. 1 and 2, the passage of the highly pressured motive liquid 16 through the venturi eductor 3 causes a suction action in the venturi eductor 3 due to the vacuum created at the intake end 5 of the eductor tube 4 and a current of liquid 12 flow at the opposite, discharge end 6 of the eductor tube 4. Liquid from a containment area means 20, as shown in FIG. 6, is drawn or sucked into the intake end 5 of the eductor tube 4 into the venturi eductor 3 at the intake end 5 to fill the vacuum created at that end by the liquid 12 flow through the eductor tube 4. This function of the venturi eductor 3 induces high flow pressures, creating or inducing, and accelerating movements of larger volumes of current of liquid 12 flow at the discharge end 6 of the eductor tube 4, higher than the intake end 5 velocities of the current of liquid 12 flow.

As depicted in FIGS. 2, 4, 5 and 6, one or more chemical introduction ports 21 are located at or near the point of maximum suction venturi, longitudinally, along the eductor tube 4, between the intake end 5 and the liquid distribution housing 7. Alternatively, additional chemical introduction ports 21 may be placed, as required, around the circumferences of said housing 7 to the venturi eductor 3. The chemical introduction port 21, or ports, enables the venturi eductor 3 to receive chemicals 19 into the chemical inlet end 22 and through the chemical line end 23 which is connected to the chemical feed line 28, causing the chemicals 19 to premix with the containment means 20 current of liquid 12 being discharged from the eductor 4. As shown in FIG. 6, the chemicals 19 introduced in the chemical introduction port 21 may be stored in a chemical safety locker 25 or other chemical storage facility and then piped to the venturi eductor 3, via the chemical feed line 28. A control valve 27 is located along the chemical feed line 28 to control flow of the chemicals 19.

FIG. 6 further shows the preferred embodiment of the present invention, comprised of a multiple of venturi nozzles 8, attached to an eductor tube 4 at acute angles to the eductor tube 4, the venturi eductor 3 being mounted on an adjustable eductor mount frame means 29. The mount frame means 29 is made of noncorrosive, rigid material, such as stainless steel or other noncorrosive material, as may be the entire apparatus. The adjustable eductor mount frame 29 may be anchored into a thrust block base, by a base anchoring means 30, or a block made of concrete or similar material, which base anchoring means 30 is designed to keep the venturi eductor 3 stationary and firmly seated within the adjustable eductor mount frame means 29 on the bottom of a liquid containment means 20, reservoir, lake or other type of liquid environment 2.

The adjustable eductor mount frame means 29, in the embodiment shown in FIG. 6, consists of a plurality of mounting locations 31 located along a plurality of vertical legs of the adjustable eductor mount frame means 29 to allow the angle of water discharge flow from the venturi eductor 3 to be adjusted for the optimum requirements of direction of dispersal of the current of liquid 12. A thrust block base may also fitted with a pump mount, made of non-corrosive material, for mounting an optional submersible pump 24 directly to the venturi eductor 3 at the motive liquid attachment means 13 of the venturi nozzle 8, shown in FIG. 5, to provide the motive water 16. The eductor tube 4 is fitted with attaching means 33, such as "picking" eye bolts, to allow for easy installation and/or retrieval of the entire apparatus 1 out of the liquid environment 2 or liquid containment means 20 for routine maintenance, or for easy retrieval during seasonal climate or industrial activity changes, for example, to avoid problems with ice forming on the surface of the liquid environment 2 or cleaning of the liquid containment means 20. Alternative embodiments may use other attaching and retrieving means, and may, along with the picking eye bolts, be attached to said mount frame means 29.

The present invention also can be used as a selective temperature modification means, a system to provide warmer or cooler liquid within the liquid environment 2 (FIGS. 1 and 5). In this function, the apparatus 1 is used to withdraw liquid of a particular temperature from one area of the liquid environment 2, such as in a reservoir, lake, or liquid containment means 20 and introduce it into an area with a differing temperature to provide a required temperature in an industrial or biologic application.

The applications of the present invention can range from a simple manual operation to a fully automatic electronic and/or computer/satellite control system. This embodiment of the present invention would reduce operating and maintenance costs, for all the uses set forth. The control valve 27, depicted in FIG. 6, to control the flow of chemicals 19 to the chemical introduction port 21 (FIG. 2) may be automatic or manual, as well. Any of a number of types of control values to supply lines common in the industry may be used. Additionally, motive liquid 16 flow may be controlled by automatic or manual valves, in alternative embodiments.

In its preferred embodiment, the apparatus 1 would provide, as depicted in FIG. 6, motive water (from, for example, a ship's existing fire fighting system) to one or, alternatively, more venturi eductors 3. The venturi eductors 3 would be mounted on brackets (the adjustable bracket mounts 29) to the ballast tank (the liquid containment means 20) at a site determined to provide the best distribution and mixing of the chemicals 19. Where advantageous or necessary, multiple venturi eductors 3 would be mounted and supplied with motive water 16 from the ship's existing fire fighting/suppression system. These motive liquid 16 supply lines 32 could be valved, either automatic, timed automatic, or manually to control the flow of motive liquid 16 to each venturi eductor 3. Chemicals 19 selected for the purpose of disinfecting or biological cleansing (as a biocide) would be stored in a storage chemical tank 25 or containment locker, and chemical feed or supply lines 28 are provided to the venturi eductor 3 or eductor array for introduction and mixing. Where, or if necessary, a booster/feed pump 24 can be installed in the chemical feed lines 28 to the venturi eductor 3 or eductor array. Said line 28 or the motive liquid supply line 32 could have a flow meter installed to determine the quantity of chemicals or liquid that were being introduced into the ballast tank or other liquid containment means 20. These flows would be controlled through valving, manual, automatic or timed, and could be controlled by a system controller/monitor, such as a CHEMTROL® 250, manufactured by Santa Barbara Control Systems, a microprocessor-based digital controller designed to maintain both sanitizer oxidation-reduction potential and water pH in residential swimming pool and spas. After a time that was determined to be sufficient to eliminate organisms, or disinfect, or cleanse the ballast tank, the motive liquid 16 to the venturi eductor 3 would be terminated either manually or through automatic valves or switches. In the alternative embodiment where multiple venturi eductors 3, or a 360° port eductor, are in use, the motive liquid 16 would be diverted and/or supplied to each unit in turn as determined by site conditions. Alternatively, additional multiple venturi nozzles 8 can be utilized on the venturi eductor 3.

In other embodiments, warning systems installed in the chemical storage locker 25 would sound an alarm either/or visual and audible in the event of chemical 19 leakage. Warning systems installed in the motive liquid supply lines 32 would sound an alarm either/or visual and audible if motive liquid 16 was interrupted.

In another embodiment of the present invention, depicted generally by FIG. 6, the apparatus 1 is a mobile unit, one or more of which could be placed in one or more ballast tanks or liquid containment means 20 units of a ship vessel as necessary, and be used in salvage operations, the apparatus 1 consisting of the following:

A. A deployment means, such as a cage, with picking eyes 33 and/or handles for lifting
B. A venturi eductor 3 with a chemical introduction port 21
C. A motive liquid 16 source
D. Chemical storage/distribution container (chemical safety or storage locker 25)
E. Piping and valving as necessary for optimum operation (control valve 27)

In this embodiment, a venturi eductor 3 would be mounted in the deployment means designed to fit through the access ports of a liquid containment 20/ballast tank. The deployment means would have deployment eyes or other handling means (such as picking eye bolts 33). The venturi eductor 33 would be sized according to the site conditions at the liquid containment means 20 unit. A motive liquid 16 source, a pump 24, such as a submersible, centrifugal or jet pump, powered by either electric, steam, gas, air, or other power source, would be mounted in the cage and piped to the said eductor 3. In an alternative embodiment, an external pump 24 could also be used and piped to the said eductor 3 via flexible or "lay flat" hose, or other delivery piping. A chemical safety locker 25 or storage canister would be mounted in the cage and attached to the chemical introduction port 21 on the venturi eductor 3. This line would be valved (control valve 27) to control flow to the eductor. The chemical safety locker 25 or canister would be sized to hold an amount of chemical 19 determined necessary, for example, as disinfectant to "cleanse" the tank being treated. The apparatus 1 unit would be deployed into the tank (liquid containment means 20) and the motive liquid source started. The chemical introduction port 21 would draw the chemicals 19 from the canister and introduce them into the venturi eductor 3 for mixing and distribution. After a time determined to be sufficient for organism elimination or disinfecting, the motive liquid 16 would be turned off and the apparatus 1 unit retrieved for storage or deployment in another tank.

In the preferred embodiment of the present invention, the invention provides a method of inducing and accelerating a current of liquid 12 in a liquid environment 2, by generating a velocity head differential, the generating means including a venturi eductor 3, thereby directing the current of liquid 12 in a desired direction and moving objects 18 in the liquid environment 2.

In the preferred embodiment of the present invention, the invention provides a method of inducing and accelerating a current of liquid 12 in a liquid containment means 20, by generating a velocity head differential, the generating means including a venturi eductor 3, using said generating means to mix chemicals 19 with the current of liquid 12 when said generating means is installed in the liquid containment means 20 and creating a desired mixture of chemicals 19 with the current of liquid 20 within the liquid containment means 20, thereby directing said mixture in said container 20 at a desired dispersal rate whereby said mixture is further dispersed and mixed in the liquid containment means.

It will be appreciated that many modifications and variations and uses of the present invention will become obvious to someone skilled in the area of the present invention. Although the description of this invention contains many specifics, these are not meant to limit the scope of the invention; they are an illustration of some of the preferred embodiments of the present invention. Although the present invention has been described in considerable detail with reference to certain preferred versions thereof, other versions are possible. The invention does not require that all the advantageous features and all the advantages need to be incorporated into every embodiment of the invention.

Additional Embodiments of the present invention:

1. Chemical-biocide treating of contained bodies of liquids, such as a ballast tank, lake, pond, or hatchery raceway;

2. Keeping solids in suspension in a contained body of liquid, such as a ballast tank, pond, lake, or hatchery raceway;
3. Moving objects, such as debris, in a body of water, such as a dam forebay, pond, lake, or river; and
4. Accelerating water to provide a current in a quiescent body of water or to alter a current in a moving body of water, such as a river, stream, creek or canal.

Having thus described in detail a preferred selection of embodiments of the present invention, it is to be appreciated and will be apparent to those skilled in the art that many physical changes could be made in the apparatus or the method without altering the invention, or the concepts and principles embodied therein. Unless otherwise specifically stated, the terms and expressions have been used herein as terms of description and not terms of limitation, and are not intended to exclude any equivalents of features shown and described or portions thereof. Various changes can, of course, be made to the preferred embodiment without departing from the spirit and scope of the present invention. The present invention, therefore, should not be restricted, except in the following claims and their equivalents.

I claim:

1. An apparatus for inducing and mixing chemicals to a current of liquid while accelerating said current, the apparatus comprising:

(a) a venturi eductor having an eductor tube including a sidewall defining a bore extending there through, said eductor tube having a liquid intake end and a liquid discharge end, the liquid intake end comprising a flared collar;

(b) a motive liquid distribution housing located toward the liquid intake end along a circumference of the eductor tube, said housing having at least one venturi nozzle having liquid inlet and outlet ends, the at least one venturi nozzle having the liquid outlet end connected in liquid conducting relationship to the eductor tube at an equally spaced interval along the circumference of the eductor tube, said nozzle directed toward the liquid discharge end of the eductor tube, and having the liquid inlet end connected in liquid conducting relationship to said housing at the equally spaced interval;

(c) a means for delivering motive liquid to the liquid distribution housing, said delivery means having a motive liquid main pipe in liquid conducting relationship to said housing and a motive liquid attachment means to cooperatively receive the motive liquid into said main pipe;

(d) a liquid distribution splitter means is contained within the motive liquid distribution housing to distributively and cavitationally control the motive liquid delivered by the delivery means; and (e) a means for introducing chemicals into the eductor tube, said means including at least one chemical induction port having a chemical inlet end and an opposite chemical line end connected in chemical conducting relationship to a chemical feed line, said port in chemical supplying relationship to the eductor tube and located on the eductor tube between the at least one venturi nozzle and the liquid intake end.

2. The apparatus as defined in claim 1, wherein the means for delivering motive liquid comprises a means for creating highly pressured motive liquid.

3. The apparatus as defined in claim 2 wherein the means for creating highly pressurized motive liquid further comprises a pump.

4. The apparatus as defined in claim 1 including an adjustable mount frame means for supporting the venturi eductor comprising a plurality of mounting locations located along a plurality of vertical legs of said frame means and a plurality of attaching means for retrieving said frame means, and a base anchoring means.

5. The apparatus as defined in claim 1 wherein the chemical introduction port further comprises a central valve located along the chemical feed line.

6. The apparatus as defined in claim 1 wherein the means for delivering motive liquid further comprises being a mobile unit.

* * * * *